US006309274B1

(12) United States Patent
Thomson et al.

(10) Patent No.: US 6,309,274 B1
(45) Date of Patent: Oct. 30, 2001

(54) MAGNETIC DRIVE AND CLUTCH ASSEMBLY

(76) Inventors: Harry Thomson, The Coach House, Bath Road, Oakhill, BA3 5AQ; David Raffo, Hill Farm House, Wicker Lane, Gilden Sutton, Chester, CH3 7EL; Shaun Woodward, Grange Court Barn, Pertenhall Road, Keysoe, Bedfordshire, MK 44 2HR; John Pape, 38 South View, Letchworth, Herfordshire, SG6 3JJ, all of (GB)

( * ) Notice: Subject to any disclaimer, the term of this patent is extended or adjusted under 35 U.S.C. 154(b) by 0 days.

(21) Appl. No.: 09/445,415

(22) PCT Filed: Jun. 9, 1998

(86) PCT No.: PCT/GB98/01540

§ 371 Date: Feb. 11, 2000

§ 102(e) Date: Feb. 11, 2000

(87) PCT Pub. No.: WO98/56478

PCT Pub. Date: Dec. 17, 1998

(30) Foreign Application Priority Data

Jun. 9, 1997 (GB) ..... 9711926

(51) Int. Cl.[7] ..... A63H 23/04

(52) U.S. Cl. ..... 446/165; 446/457

(58) Field of Search ..... 446/129, 139, 446/153, 156, 157, 158, 162, 163, 164, 457, 160, 165, 431

(56) References Cited

U.S. PATENT DOCUMENTS

| | | | | |
|---|---|---|---|---|
| 3,793,769 | * | 2/1974 | Tong | 446/165 |
| 3,824,735 | * | 7/1974 | Brandstatter | 446/165 |
| 5,453,035 | * | 9/1995 | Jenkins | 446/165 |

* cited by examiner

*Primary Examiner*—Sam Rimell
(74) *Attorney, Agent, or Firm*—Venable; John P. Shannon; Chad Anderson

(57) ABSTRACT

The present invention relates to a magnetic drive and clutch assembly, especially to an assembly suitable for use in radio or remote-controlled toys and model vehicles. There is described a magnetic drive for a wheel or other rotating body comprising (i) a motor assembly (23) coupled to an axle (30) carrying a housing (14) carrying at least one drive magnet (15) of a chosen polarity, and (ii) a wheel (27) or other rotating body including at least one wheel magnet (9) of the opposite polarity; the motor assembly and wheel (or other rotating body) being mounted for support such that the drive (15) and wheel (9) magnets are positioned adjacently axially with a spacing therebetween.

13 Claims, 2 Drawing Sheets

MAGNETIC DRIVE AND CLUTCH ASSEMBLY

The present invention relates to a magnetic drive and clutch assembly, especially to an assembly suitable for use in radio or remote-controlled toys and model vehicles.

U.S. Pat. No. 4,902,260, which is considered to constitute the closest prior art, describes an amphibious car adapted for motion in water and upon land and having a plurality of paddle wheels. DE 3240608 A1 describes a submersible submarine which includes a propeller driven by means of a magnetic drive arrangement. A plate carrying two magnets is secured onto the shaft of a drive motor in a waterproof housing. The propeller shaft is fitted with a further disc having two holes each of which is fitted with two round permanent magnets.

According to the present invention, there is provided a toy adapted for motion in water and upon land and having a waterproof housing and a plurality of paddle wheels driven by a magnetic drive, the drive comprising (i) a motor assembly coupled to an axle carrying a corresponding plurality of mounts each carrying at least one drive magnet of a chosen polarity, and (ii) at least one wheel magnet of opposite polarity associated with each paddle wheel; the magnet mounts and wheels being mounted for support such that the drive and wheel magnets are axially adjacent with a spacing therebetween; the motor assembly, magnet mount and axle being housed within the waterproof housing; and wherein the magnetic strength of the drive magnets and wheel magnets are selected to produce a magnetic interaction of such strength that if a wheel encounters an obstacle, the magnetic drive system acts also as a clutch.

The present invention also provides a toy duck having the features of the toy described above.

The above and other aspects of the present invention will be described in further detail by way of example only with reference to the accompanying drawings, in which.

Figure 1:
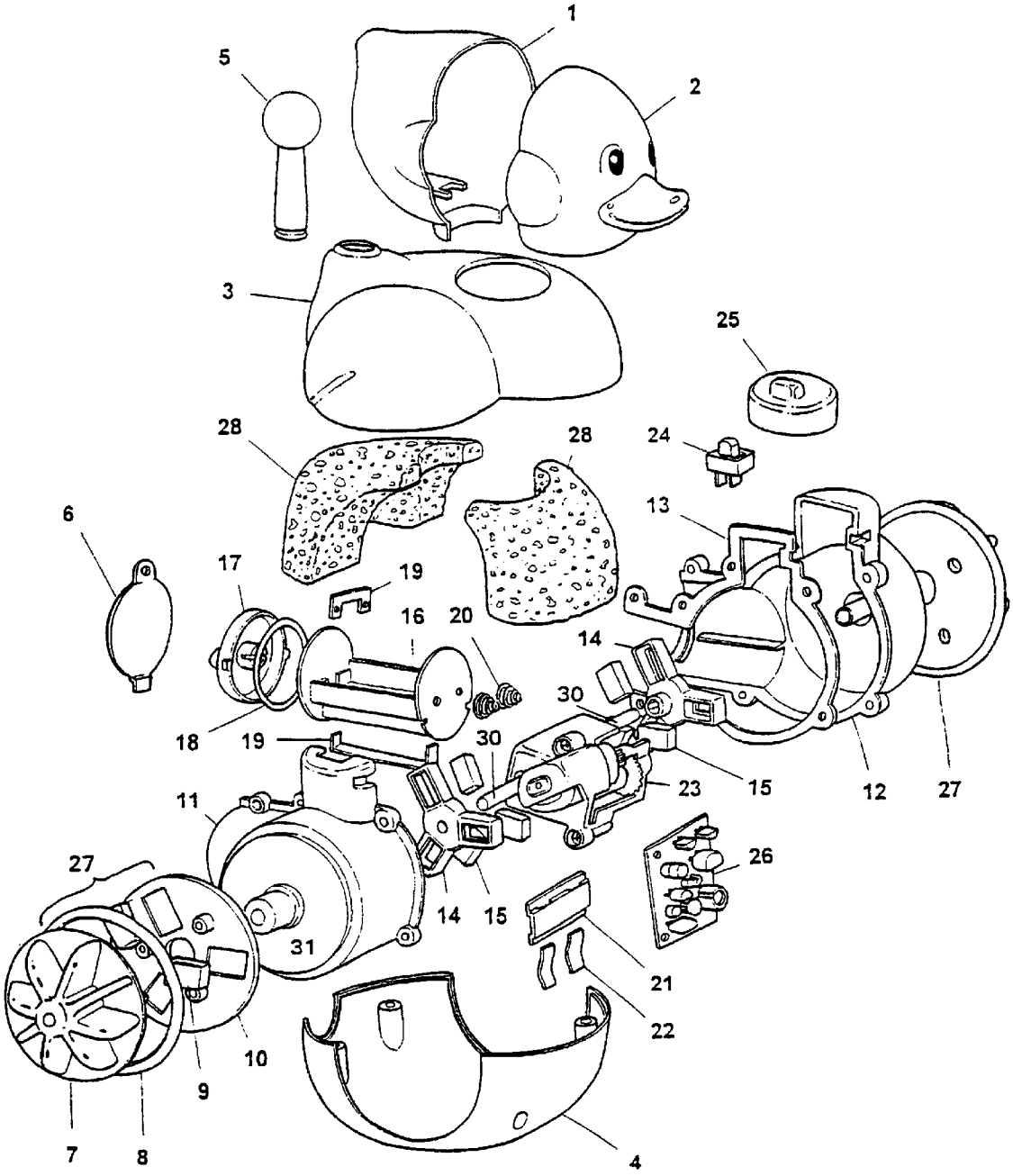
FIG. 1 is an exploded perspective view of a toy duck incorporating an embodiment of a magnetic drive in accordance with the present invention.
Figure 2:
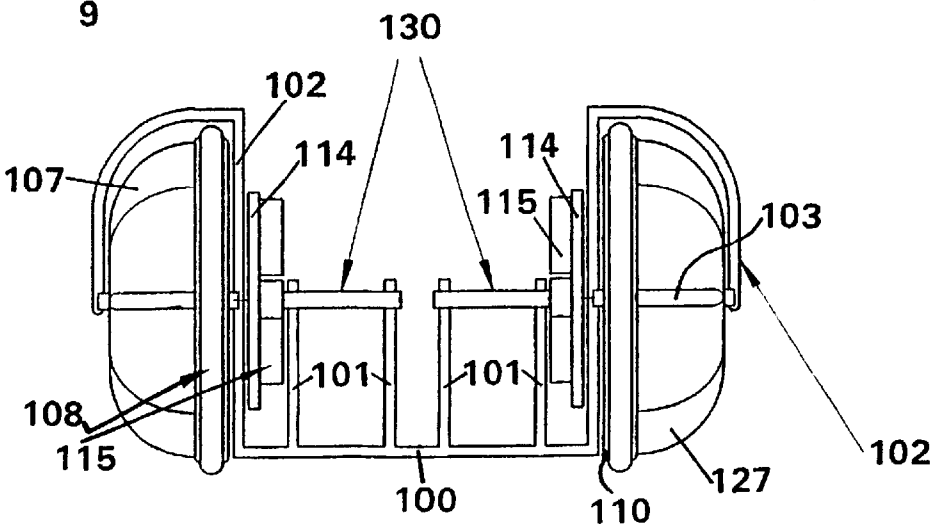
FIG. 2 is a front view of a chassis including a second embodiment of a magnetic drive.

FIGS. 3*a* and 3*b* show respectively front and rear views of the external drive wheel of the embodiment of FIG. 1; and FIGS. 4*a* and 4*b* show respectively front and rear views of the internal drive wheel of the embodiment of FIG. 2.

Referring to FIG. 1, an embodiment of a magnetic drive in accordance with the present invention is shown applied to a radio controlled duck toy. The duck includes a two part body 3,4 and two part head 1,2. The duck includes two paddle wheels 7 driven by a motor 23 through a magnetic drive assembly which will be described in further detail below. The motor is powered by means of batteries or cells (not shown) held in a battery cartridge 16 in electrical connection with the motor in a conventional manner. The duck shown is intended for use upon water (for example in a bath) and so it is important to be able to isolate the motor 23 and its battery power supply 16–20 from water. Accordingly, the motor and battery components are all mounted within a waterproof inner housing 11 which incorporates waterproof seals as necessary (seal or gasket 13 between the two halves of the housing itself and seal 18 to the battery compartment). The movement of the duck is controlled from a radio control handset (not shown) transmitting control signals which are received by an aerial 5 on the back of the duck and processed by a control circuit 26 causing, in turn, operation of the motor 23.

The magnetic drive assembly includes a battery powered motor 23 with suitable gear box with two rotating output axles 30. Upon the end of each axle 30 is a mounting 14 carrying, as shown, three drive magnets 15 of chosen polarity. The motor 23, output axles 30 and drive magnet mountings 14 are all provided within the inner housing 11.

Figure 3:
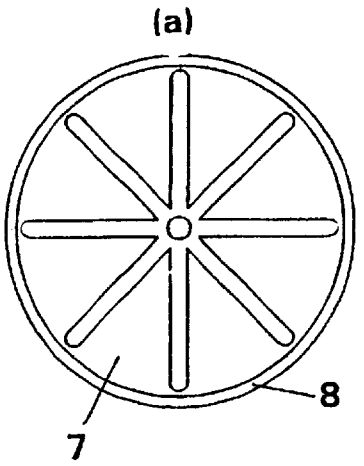

Mounted on the outside of the waterproof inner housing 11 are two paddle wheels 27 which are mounted for free rotation upon stub axle mountings 31, the external part of which can be seen in FIG. 1 on the duck's right side and the inner part of which can be seen on the duck's left side. Each paddle wheel 27 consists of a paddle 7 secured to a back plate 10 upon which, as shown, three magnets 9 are mounted. FIG. 3 shows the paddle wheels 27 in further detail. Wheel magnets 9 are, of course, selected to be of the opposite polarity to the drive magnets 15. In the embodiment shown, each paddle wheel 27 is also provided with a rubber tyre 8, to aid grip of the wheels on dry land.

There need not be equal numbers of drive and wheel magnets, although such will, in general, be most suitable. Permanent magnets will be most generally applicable, but electromagnets may, in some cases, be suitable and preferred.

The respective strengths of the drive and wheel magnets will be selected with a view to how the apparatus including the drive system will be used. The weight of the product will also influence the required strength of the magnetic interactions. By selection of appropriate magnet strengths, the drive system will also act as a clutch, slipping if the wheel encounters an obstacle. Those skilled in the art will be readily able to determine suitable combinations of magnets without undue burden.

The individual components of the duck not otherwise described are manufactured from conventional materials such as injection moulded plastics for the body parts.

Figure 4:
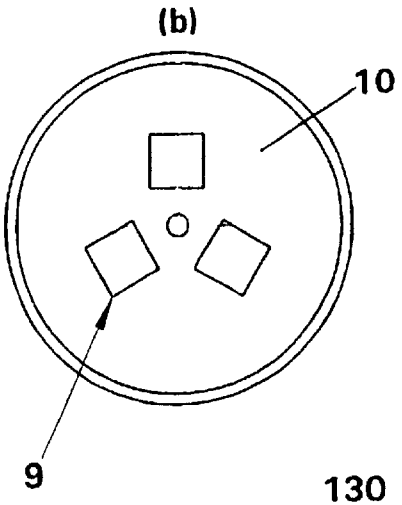
Figure 4:
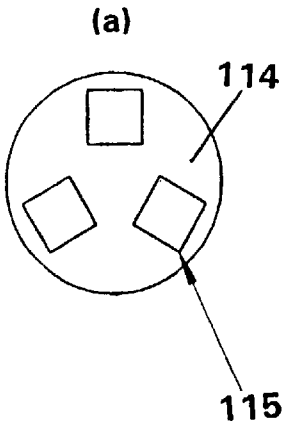
Figure 4:
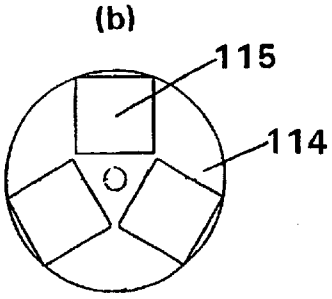

FIG. 2 shows an alternative arrangement for mounting the wheels with respect to the drive magnets mounting. A chassis 100 includes supports 101 for the drive magnet housing axles 130 (the motor has been omitted for clarity). The drive magnet mountings 114 and magnets 115 are shown in more detail in FIG. 4. Chassis 100 also includes a support or cage 102 supporting both ends of the axle 103 of each wheel 127. The remaining features of the arrangement are as described above for FIG. 1. FIG. 4 shows a drive magnet mounting in the form of a plate 114 with three permanent magnets 115 rebated into apertures in the plate 114. The chassis could be injection moulded from plastics material, cast in metal or punched and folded from sheet metal as is most appropriate in the particular circumstances.

With appropriate selection of magnetic field strength, the drive arrangement of the present invention has the addition advantage of acting as an automatic clutch. This has advantageous safety implications as it has the effect that if a child inserts a finger into the drive mechanism the 'clutch' will slip, avoiding harm to the child. This advantage will be of benefit whether the drive is intended to be used in a water environment or on 'dry-land'.

Although the above aspects of the present invention have been described with respect to a toy, radio-controlled, duck, the drive and clutch assembly are equally applicable to other toy or model designs whether radio or remotely controlled or otherwise.

What is claimed is:

1. A toy adapted for motion in water and upon land and having a waterproof housing and a plurality of paddle wheels driven by a magnetic drive, the drive comprising:

(i) a motor assembly coupled to an axle carrying a corresponding plurality of magnet mounts each carrying at least one drive magnet of a chosen polarity, and (ii) at least one wheel magnet of opposite polarity associated with each paddle wheel;

the magnet mounts and wheels being mounted for support such that the drive magnets and wheel magnets are axially adjacent with a spacing therebetween;

the motor assembly, magnet mount and axle being housed within the waterproof housing; and wherein the drive magnets and wheel magnets produce a magnetic interaction of a strength sufficient for unobstructed rotation of one of said wheels but insufficient for rotation of one of said wheels when any of said wheels encounters an obstacle, whereby the drive magnets and wheel magnets act as a clutch.

2. A toy as claimed in claim 1 further including means to enable remote actuation of the motor.

3. A toy as claimed in claim 2 wherein the remote actuation is by means of radio control.

4. A toy as claimed in claim 1, wherein the paddle wheel is further provided with a rubber tire.

5. A toy as claimed in claim 1 which is a toy duck.

6. A toy as claimed in claim 2, wherein the paddle wheel is further provided with a rubber tire.

7. A toy as claimed in claim 3, wherein the paddle wheel is further provided with a rubber tire.

8. A toy as claimed in claim 2 which is a toy duck.

9. A toy as claimed in claim 3 which is a toy duck.

10. A toy as claimed in claim 4 which is a toy duck.

11. A toy as claimed in claim 6 which is a toy duck.

12. A toy as claimed in claim 7 which is a toy duck.

13. A toy adapted for motion in water and upon land and having a waterproof housing and a plurality of paddle wheels driven by a magnetic drive, the drive comprising:

(i) a motor assembly coupled to an axle carrying a corresponding plurality of magnet mounts each carrying at least one drive magnet of a chosen polarity, and (ii) at least one wheel magnet of opposite polarity associated with each paddle wheel;

the magnet mounts and wheels being mounted for support such that the drive magnets and wheel magnets are axially adjacent with a spacing therebetween;

the motor assembly, magnet mount and axle being housed within the waterproof housing;

wherein the drive magnets and the wheel magnets also comprise a clutch in which the drive magnets and the wheel magnets produce a magnetic interaction and decouple from one another if a wheel encounters an obstacle.

* * * * *